US009827473B2

(12) United States Patent
Knight

(10) Patent No.: US 9,827,473 B2
(45) **Date of Patent: *Nov. 28, 2017**

(54) GOLF CLUB HEAD OR OTHER BALL STRIKING DEVICE HAVING REINFORCED SOLE

(71) Applicant: Karsten Manufacturing Corporation, Phoenix, AZ (US)

(72) Inventor: William C. Knight, Granbury, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/203,422

(22) Filed: Jul. 6, 2016

(65) Prior Publication Data

US 2016/0310810 A1 Oct. 27, 2016

Related U.S. Application Data

(63) Continuation of application No. 13/787,175, filed on Mar. 6, 2013, now Pat. No. 9,393,473.

(51) Int. Cl.
*A63B 53/04* (2015.01)
*A63B 60/54* (2015.01)

(52) U.S. Cl.
CPC ..... *A63B 60/54* (2015.10); *A63B 53/047* (2013.01); *A63B 53/0466* (2013.01);
(Continued)

(58) Field of Classification Search
CPC ..... A63B 59/0092
See application file for complete search history.

(56) References Cited

U.S. PATENT DOCUMENTS 5,295,689 A * 3/1994 Lundberg ..... A63B 53/04 473/346
5,318,300 A * 6/1994 Schmidt ..... A63B 53/04 473/305

(Continued)

FOREIGN PATENT DOCUMENTS

JP H09-173510 A 7/1997
JP H09-285578 A 11/1997

(Continued)

OTHER PUBLICATIONS

Aug. 3, 2010—(WO) International Search Report and Written Opinion—App PCT/US2010/031542.

*Primary Examiner* — Michael Dennis

(57) ABSTRACT

A head for a ball striking device includes a bracing member connected to an upper sole surface located on the sole of the body opposite the bottom sole surface. The bracing member includes a first end connected to a first point on the upper sole surface, a second end connected to a second point on the upper sole surface spaced from the first point, and a bridge portion extending between the first and second ends. The bridge portion extends upward from the upper sole surface and is spaced from the upper sole surface. The bridge portion may be formed by one or more trusses, and may define a generally triangular shape in one embodiment. The first and second ends may be connected to the upper sole surface using a variety of techniques, e.g., welding or other integral joining technique, integral forming, adhesive or other bonding material, or other technique.

21 Claims, 12 Drawing Sheets

(52) U.S. Cl.
CPC . *A63B 2053/045* (2013.01); *A63B 2053/0433* (2013.01); *A63B 2053/0437* (2013.01); *A63B 2053/0454* (2013.01); *Y10T 29/49826* (2015.01); *Y10T 29/49995* (2015.01)

(56) References Cited

U.S. PATENT DOCUMENTS

| | | | | |
|---|---|---|---|---|
| 5,464,211 | A | 11/1995 | Atkins, Sr. | |
| 5,839,975 | A | 11/1998 | Lundberg | |
| 5,842,934 | A | 12/1998 | Ezaki et al. | |
| 5,941,782 | A * | 8/1999 | Cook | A63B 53/04 473/346 |
| 5,997,415 | A * | 12/1999 | Wood | A63B 53/04 473/346 |
| 6,017,280 | A | 1/2000 | Hubert | |
| 6,059,669 | A | 5/2000 | Pearce | |
| 6,299,547 | B1 | 10/2001 | Kosmatka | |
| 6,309,311 | B1 | 10/2001 | Lu | |
| 6,319,148 | B1 | 11/2001 | Tom | |
| 6,379,262 | B1 | 4/2002 | Boone | |
| 6,475,101 | B2 | 11/2002 | Burrows | |
| 6,558,271 | B1 | 5/2003 | Beach et al. | |
| 7,140,977 | B2 | 11/2006 | Atkins, Sr. | |
| 7,651,414 | B2 | 1/2010 | Rae et al. | |
| 7,789,774 | B2 | 9/2010 | Rae et al. | |
| 7,854,665 | B2 | 12/2010 | Dewhurst et al. | |
| 7,854,666 | B2 | 12/2010 | Horacek et al. | |
| 7,959,523 | B2 | 6/2011 | Rae et al. | |
| 7,998,000 | B2 * | 8/2011 | Brekke | A63B 53/0466 473/345 |
| 8,357,056 | B2 | 1/2013 | Horacek et al. | |
| 8,827,834 | B2 | 9/2014 | Horacek et al. | |
| 2003/0190975 | A1 | 10/2003 | Fagot | |
| 2003/0228928 | A1 | 12/2003 | Yabu | |
| 2007/0173347 | A1 | 7/2007 | Willett et al. | |
| 2011/0207552 | A1 | 8/2011 | Finn et al. | |
| 2015/0057102 | A1 | 2/2015 | Horacek et al. | |

FOREIGN PATENT DOCUMENTS

| | | | |
|---|---|---|---|
| JP | 2001-299970 | A | 10/2001 |
| JP | 2004-033536 | A | 2/2004 |
| JP | 2004-174100 | A | 6/2004 |
| JP | 2004-358225 | A | 12/2004 |
| JP | 2007-007063 | A | 1/2007 |
| WO | 2006-044631 | A2 | 4/2006 |
| WO | 2007-095170 | A2 | 8/2007 |

* cited by examiner

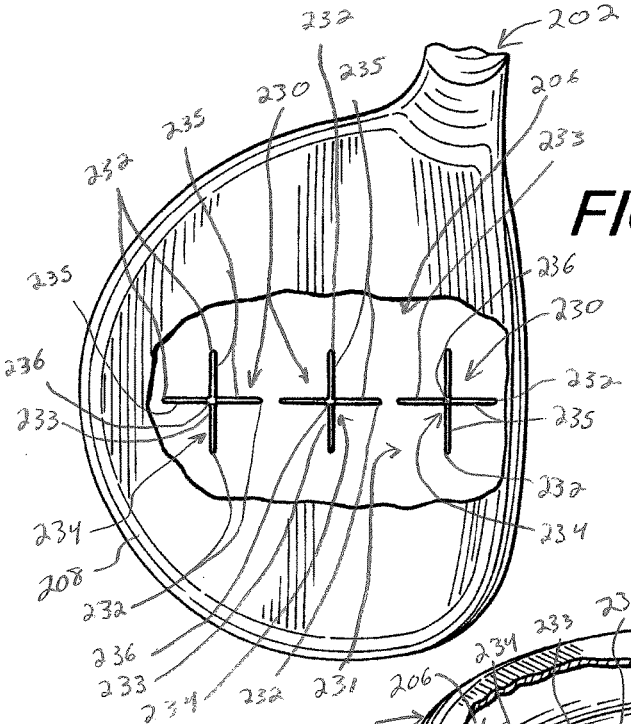
FIG. 9
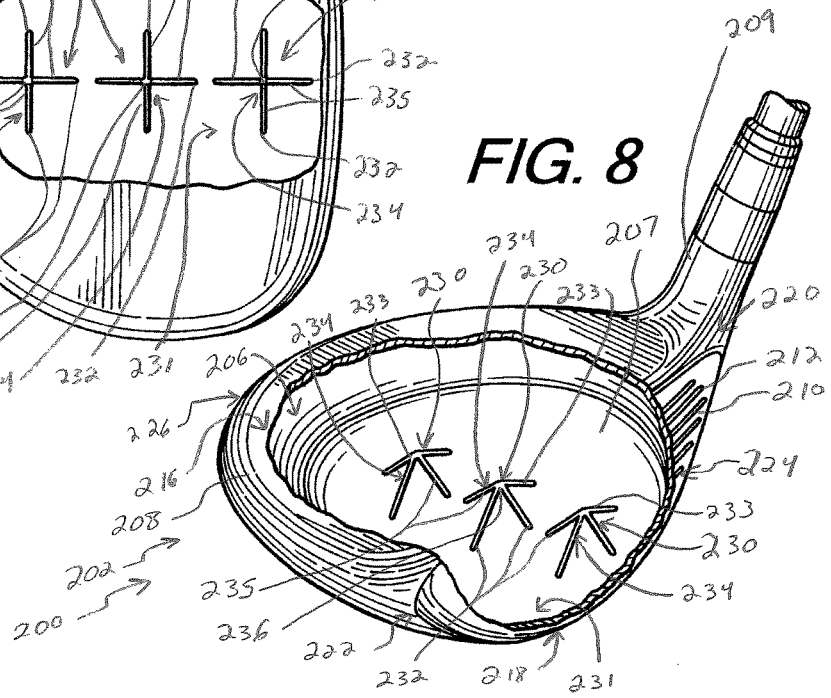
FIG. 8
FIG. 10
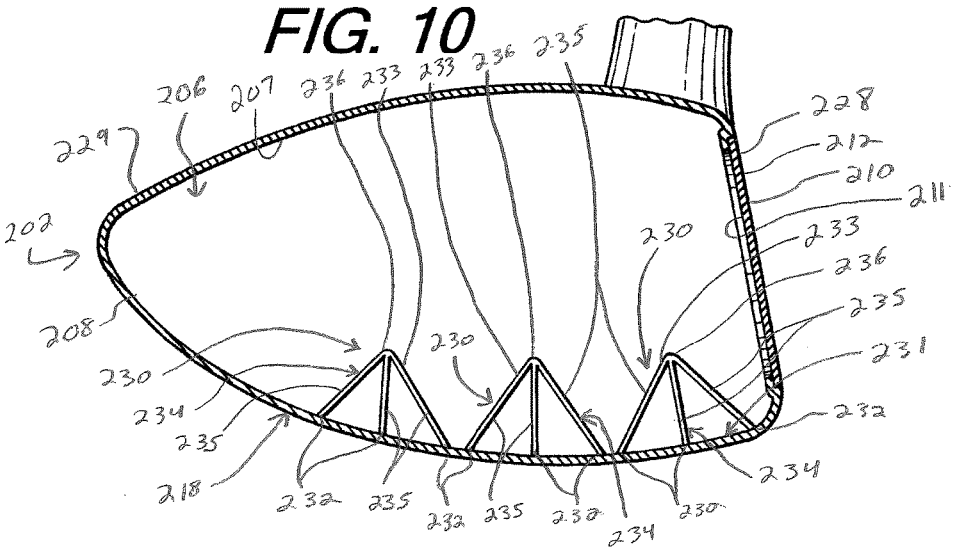

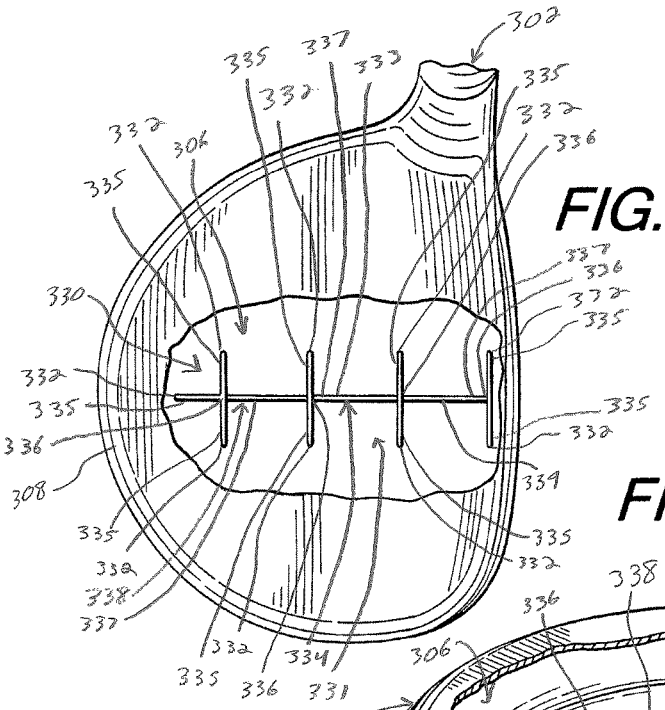
FIG. 12
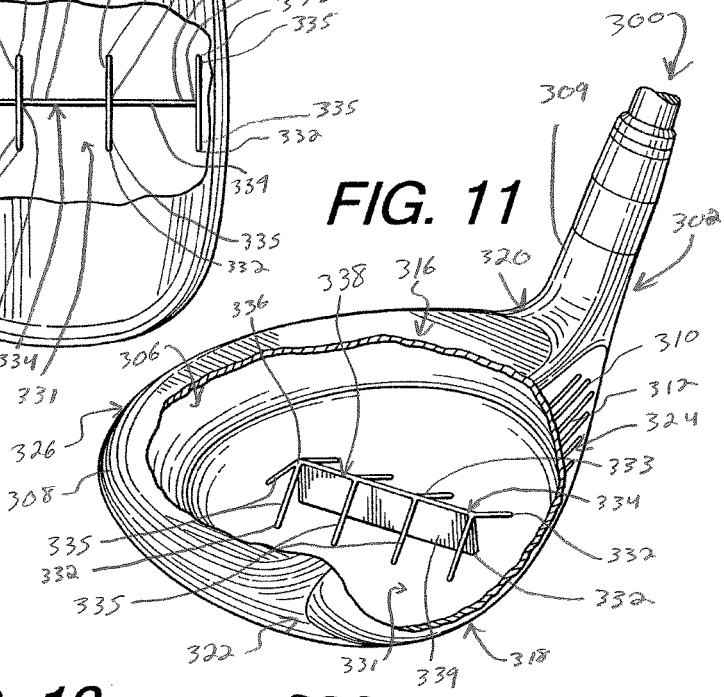
FIG. 11
FIG. 13
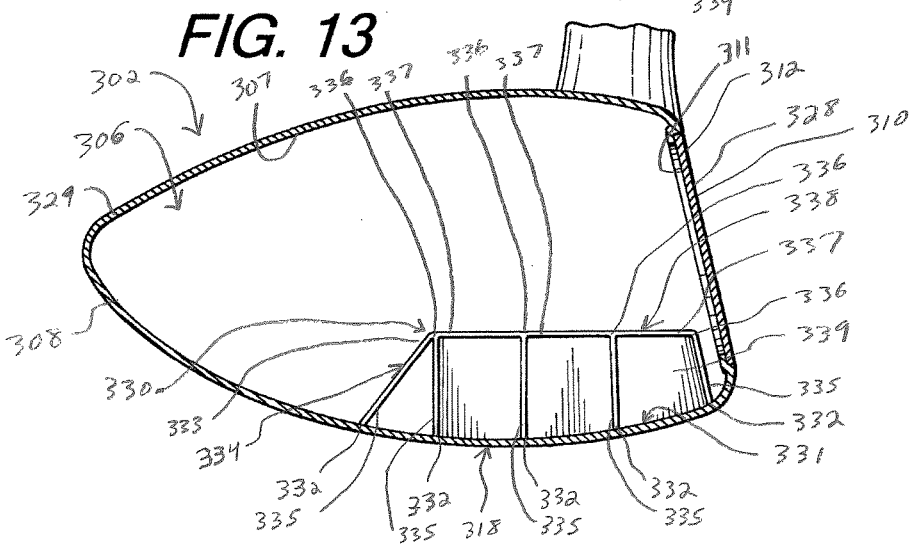

GOLF CLUB HEAD OR OTHER BALL STRIKING DEVICE HAVING REINFORCED SOLE

CROSS-REFERENCE TO RELATED APPLICATION

This application is a continuation of and claims priority to U.S. patent application Ser. No. 13/787,175, filed Mar. 6, 2013, which prior application is incorporated by reference herein in its entirety.

TECHNICAL FIELD

The invention relates generally to ball striking devices, such as golf clubs and golf club heads, having a reinforced sole. Certain aspects of this invention relate to golf club heads having one or more a bracing members connected to the sole and extending upward from the sole.

BACKGROUND

The vibration or resonance of certain components of a ball striking device, such as a golf club head, during impact may influence the energy and velocity transferred to the ball upon impact. Excessive vibration or resonance can increase damping and thereby cause energy loss or dissipation, reducing the energy and velocity transferred to the ball. Accordingly, technologies that can reduce or otherwise optimize the resonance and vibration of components of a ball striking device during impact can be advantageous in producing greater impact energy and velocity.

Additionally, the vibration or resonance of certain components of a ball striking device during impact can affect the sound and/or feel of the impact. Excessive vibration or resonance can produce undesirable sounds and poor feel for the user, and may even sting or otherwise cause pain to the user's hands. Accordingly, technologies that can reduce or otherwise optimize the resonance and vibration of components of a ball striking device during impact can be advantageous in producing improved sound and feel upon impact.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face and extending rearwardly from the face, with the body having a sole with a bottom sole surface configured to confront a playing surface. The head may include features that can improve the resonance of the sole and/or the head as a whole. Various example structures of heads described herein include a bracing member connected to an upper sole surface located on the sole of the body opposite the bottom sole surface. The bracing member includes a first end connected to a first point on the upper sole surface, a second end connected to a second point on the upper sole surface spaced from the first point, and a bridge portion extending between the first end and the second end. The bridge portion extends upward from the upper sole surface and is spaced from the upper sole surface. The bridge portion may be formed by one or more trusses, and may define a generally triangular shape in one embodiment. Additionally, the first and second ends may be connected to the upper sole surface using a variety of techniques, such as welding or other integral joining technique, integral forming, adhesive or other bonding material, or another technique.

According to one aspect, the bracing member includes a first truss having the first end and a first distal end opposite the first end and a second truss having the second end and a second distal end opposite the second end. The first truss and the second truss extend upward from the upper sole surface to form at least a portion of the bridge portion. The first truss may be joined to the second truss at the first and second distal ends, such that the first and second trusses define a generally triangular shape. In this configuration, the first end, the second end, and the first and second distal ends combined form the three corners of the generally triangular shape.

According to another aspect, the bracing member includes a plurality of trusses, including a first truss and a second truss as described above, as well as a third truss having a third end connected to a third point on the upper sole surface that is spaced from the first and second points and a third distal end opposite the third end and a fourth truss having a fourth end connected to a fourth point on the upper sole surface that is spaced from the first, second, and third points and a fourth distal end opposite the fourth end. The first, second, third, and fourth trusses extend upward from the upper sole surface to form at least a portion of the bridge portion. The first, second, third, and fourth trusses may be joined together at the first, second, third, and fourth distal ends. The bridge member may also include a connecting truss extending between the first distal end at least one of the second, third, and fourth distal ends, where the connecting truss is spaced from the upper sole surface.

According to a further aspect, the head also has at least a second bracing member connected to the upper sole surface separate from the bracing member. The second bracing member includes a third end connected to a third point on the upper sole surface, a fourth end connected to a fourth point on the upper sole surface spaced from the third point, and a second bridge portion extending between the third end and the fourth end. The second bridge portion extends upward from the upper sole surface and is spaced from the upper sole surface. The head may further include three or more bracing members, and all such bracing members may be identical or substantially identical.

According to yet another aspect, the first end of the bracing member may be connected to the upper sole surface along a first line including the first point, with the second end connected to the upper sole surface along a second line including the second point, where the first and second lines are spaced from each other. In this configuration, the bridge portion may be in the form of an arch extending upward from the first and second lines and being spaced from the upper sole surface between the first and second lines. The first and second lines may be parallel to each other.

Additional aspects of the invention relate to a wood-type golf club head that includes a face having an outer surface configured for striking a ball and a rear surface opposite the outer surface, and a body joined to the face around peripheral edges of the face and extending rearwardly from the face. The body and the face combine to define an internal cavity bounded by the rear surface of the face and a plurality of inner surfaces of the body, and the body has a crown and a sole opposite the crown. The head also includes a bracing member connected to an inner sole surface located on the sole of the body. The bracing member includes a first truss having a first end connected to a first point on the inner sole surface and a first distal end opposite the first end, a second truss having a second end connected to a second point on the inner sole surface spaced from the first point and a second distal end opposite the second end, and a bridge portion extending between the first end and the second end. The bridge portion extends upward from the inner sole surface and is spaced from the inner sole surface, and the first truss and the second truss extend upward from the inner sole surface to form at least a portion of the bridge portion. The first and second ends may be connected to the inner sole surface using a variety of techniques, as described above.

According to one aspect, the first truss is joined to the second truss at the first and second distal ends, and the first and second trusses define a generally triangular shape. The first end, the second end, and the first and second distal ends combined form three corners of the generally triangular shape.

According to another aspect, the bracing member also includes a third truss having a third end connected to a third point on the inner sole surface that is spaced from the first and second points and a third distal end opposite the third end, and a fourth truss having a fourth end connected to a fourth point on the inner sole surface that is spaced from the first, second, and third points and a fourth distal end opposite the fourth end. The first, second, third, and fourth trusses extend upward from the inner sole surface to form at least a portion of the bridge portion. The first, second, third, and fourth trusses may be joined together at the first, second, third, and fourth distal ends in one embodiment. In another embodiment, the bracing member may further include a connecting truss extending between the first distal end at least one of the second, third, and fourth distal ends, where the connecting truss is spaced from the inner sole surface.

According to a further aspect, the head also includes a second bracing member connected to the inner sole surface separate from the bracing member, the second bracing member including a third truss having a third end connected to a third point on the inner sole surface and a third distal end opposite the third end, and a fourth truss having a fourth end connected to a fourth point on the inner sole surface spaced from the third point and a fourth distal end opposite the fourth end, and a second bridge portion extending between the third end and the fourth end. The second bridge portion extends upward from the inner sole surface and is spaced from the inner sole surface, and the third truss and the fourth truss extend upward from the inner sole surface to form at least a portion of the second bridge portion.

Further aspects of the invention relate to a ball striking device including a face having an outer surface configured for striking a ball and a rear surface opposite the outer surface, a body joined to the face around peripheral edges of the face and extending rearwardly from the face, with the body having a sole with a bottom sole surface configured to confront a playing surface, and a bracing member connected to an upper sole surface located on the sole of the body opposite the bottom sole surface. The bracing member includes a bridge portion that extends upwardly from the upper sole surface and is spaced from the upper sole surface. Additionally, the bridge portion includes a plurality of trusses each having a first end connected to the upper sole surface and extending upward to a second end spaced above the upper sole surface, with the first ends of the plurality of trusses each being connected to the upper sole surface at separate points.

According to one aspect, the bracing member further includes a connecting truss that is spaced from the upper sole surface. The second ends of the plurality of trusses are connected to the connecting truss, such that each of the plurality of trusses depends from the connecting truss.

Other aspects of the invention relate to a golf club head that includes a face having an outer surface configured for striking a ball and a rear surface opposite the outer surface and a body joined to the face around peripheral edges of the face and extending rearwardly from the face, where the body and the face combine to define an interior cavity surrounded by an interior surface of the head, such that the interior surface comprises the rear surface of the face and inner surfaces of the body, with a bracing member connected to the interior surface of the head. The bracing member has a first end connected to a first point on the interior surface, a second end connected to a second point on the interior surface spaced from the first point, and a bridge portion extending between the first end and the second end. The bridge portion extends inward from the interior surface and is spaced from the interior surface.

According to one aspect, the bracing member comprises a first truss having the first end and a first distal end opposite the first end and a second truss having the second end and a second distal end opposite the second end, wherein the first truss and the second truss extend inward from the interior surface to form at least a portion of the bridge portion.

According to another aspect, the bracing member may have the first and second ends connected to an upper sole surface or a lower crown surface of the body.

According to a further aspect, the bracing member may be positioned at a rear of the ball striking device and has the first end connected to an upper sole surface of the body and the second end connected to a lower crown surface of the body.

According to yet another aspect, the bracing member is positioned at a front of the ball striking device and has the first end connected to an upper sole surface or a lower crown surface of the body and the second end connected to the rear surface of the face.

Still further aspects of the invention relate to a ball striking device including a face having an outer surface configured for striking a ball and a rear surface opposite the outer surface, a body joined to the face around peripheral edges of the face and extending rearwardly from the face, with the body having a sole with a bottom sole surface configured to confront a playing surface, and a bracing member connected to an upper sole surface located on the sole of the body opposite the bottom sole surface. The bracing member includes a spine member spaced from the upper sole surface and a plurality of legs connected to the spine member and extending outwardly and downwardly from the spine member. Each of the legs has a lower end connected to the upper sole surface and an upper or distal end connected to the spine member.

According to one aspect, the plurality of legs includes a first leg and a second leg arranged as a pair and extending outwardly from opposite lateral sides of the spine member at a first location along the length of the spine member, a third leg and a fourth leg arranged as another pair and extending outwardly from the opposite lateral sides of the spine member at a second location along the length of the spine member, a fifth leg extending outwardly from a first end of the spine member and a sixth leg extending outwardly from a second end of the spine member. The plurality of legs may further include a seventh leg and an eighth leg arranged as a third pair and extending outwardly from opposite lateral sides of the spine member at a third location along the length of the spine member, and a ninth leg and a tenth leg arranged as a fourth pair and extending outwardly from the opposite lateral sides of the spine member at a fourth location along the length of the spine member. In one embodiment, the first location may be at the first end of the spine member such that the first leg and the second leg extend outwardly from opposite lateral sides of the spine member at the first end, and the second location may be at the second end of the spine member such that the third leg and the fourth leg extend outwardly from opposite lateral sides of the spine member at the second end. If the bracing member includes ten legs as described above, in this configuration, the third and fourth locations may be located between the first and second locations on the spine member.

According to another aspect, the bracing member further includes a wall member depending from an underside of the spine member and having an elongated end connected to the upper sole surface.

According to a further aspect, the bracing member includes a first leg and a second leg arranged as a pair and extending outwardly from opposite lateral sides from a point on the spine member, and the first and second legs define a generally triangular shape. In this configuration, the lower end of the first leg, the lower end of the second leg, and the spine member form three corners of the generally triangular shape.

Other aspects of the invention relate to a method for producing a ball striking head as described above, or in a different configuration. The method is used in connection with a ball striking device that has been provided with a face having an outer surface configured for striking a ball and a rear surface opposite the outer surface, a body configured to be joined to the face around peripheral edges of the face and extend rearwardly from the face, with the body having a sole with a bottom sole surface configured to confront a playing surface, and a block of material integrally connected to the upper sole surface and extending upwardly from the upper sole surface. The block is machined to remove material from the block, creating a bracing member connected to an upper sole surface located on the sole of the body opposite the bottom sole surface. The resultant bracing member includes a first end connected to a first point on the upper sole surface, a second end connected to a second point on the upper sole surface spaced from the first point, and a bridge portion extending between the first end and the second end, the bridge portion extending upward from the upper sole surface and being spaced from the upper sole surface. The bracing member created may have any of the features described herein with respect to ball striking heads according to aspects of the invention. The body may be joined to the face after machining the block.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 8 is a broken-away perspective view of another embodiment of a ball-striking device according to aspects of the invention, in the form of a wood-type golf club head, showing internal detail;

FIG. 9 a broken-away top view of the head of FIG. 8, showing internal detail;

FIG. 10 a cross-sectional view of the head of FIG. 8;

FIG. 11 is a broken-away perspective view of another embodiment of a ball-striking device according to aspects of the invention, in the form of a wood-type golf club head, showing internal detail;

FIG. 12 a broken-away top view of the head of FIG. 11, showing internal detail;

FIG. 13 a cross-sectional view of the head of FIG. 11;

DETAILED DESCRIPTION

Figures 1, 2:
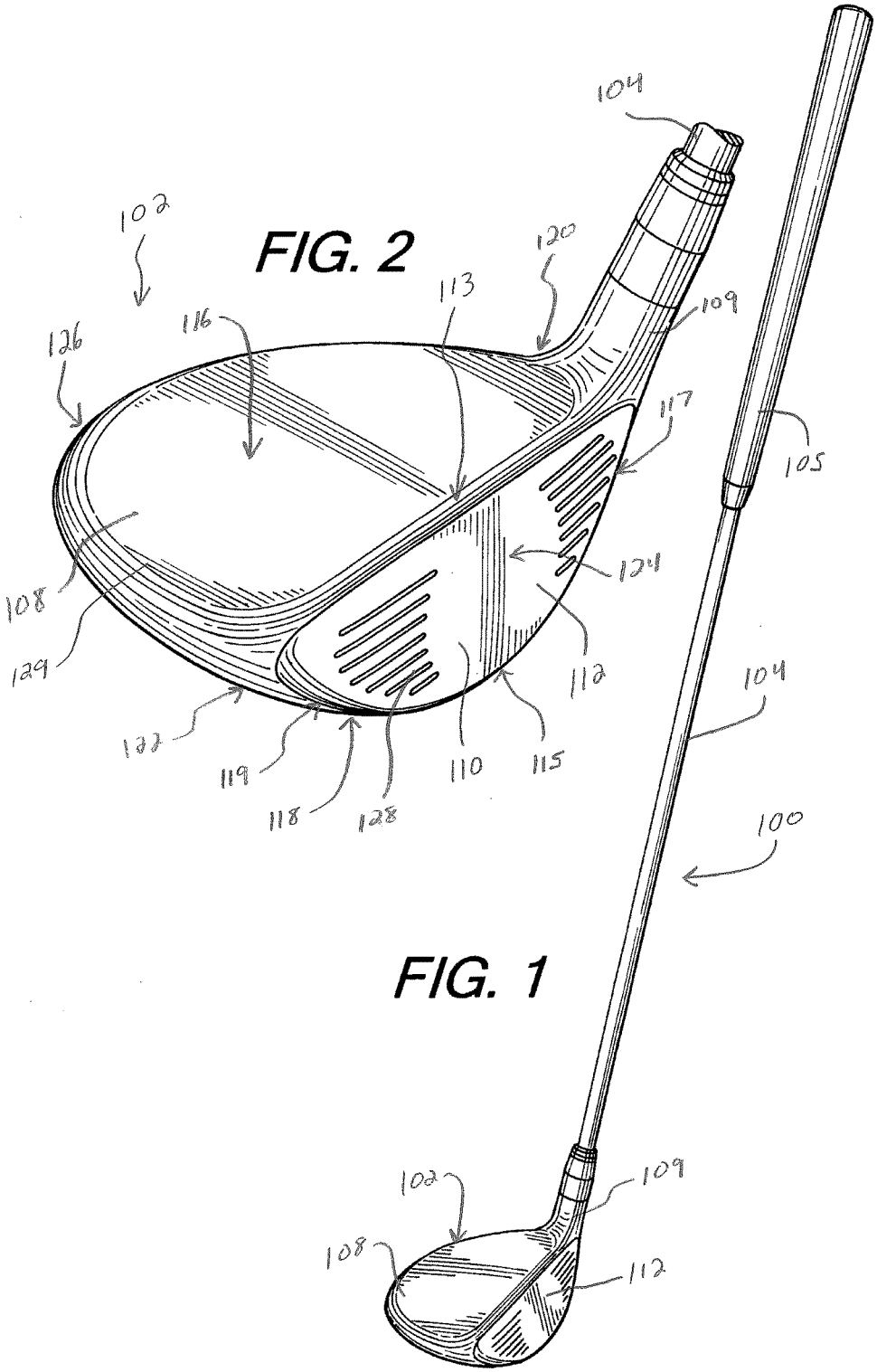
FIG. 1 is a perspective view of one embodiment of a ball striking device according to aspects of the invention, in the form of a wood-type golf club.
FIG. 2 is a perspective view of a head of the ball striking device of FIG. 1.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Generally triangular shape" means an enclosed shape that has three identifiable sides, which may be straight or curvilinear or a combination thereof, and three identifiable corners, which may be angular or rounded or a combination thereof.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects of this invention relate to wood-type golf clubs and golf club heads, including drivers, fairway woods, hybrid-type clubs, iron-type golf clubs, and the like, although aspects of this invention also may be practiced on other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs, including drivers. Such devices may include a one-piece construction or a multiple-piece construction. An example structure of ball striking devices according to this invention will be described in detail below in conjunction with FIGS. 1-5, and will be referred to generally using reference numeral "100."

FIGS. 1-5 illustrate an example of a ball striking device 100 in the form of a golf driver, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-5 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No.

2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIGS. 1-5, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. It is understood that the head 102 may be configured as a different type of ball striking device in other embodiments, including other types of wood-type golf club heads, such as a fairway wood, hybrid, etc. When configured as a fairway wood head, the club head may have a volume of at least 120-230 cc, and when configured as a hybrid club head, the club head may have a volume of at least 85-140 cc. Other appropriate sizes for other club heads may be readily determined by those skilled in the art.

In the embodiment illustrated in FIGS. 1-5, the head 102 has a hollow structure defining an inner cavity 106 (e.g., defined by the face 112 and the body 108). Thus, the head 102 has an interior surface defined by a plurality of inner surfaces, including inner body surfaces 107 and a rear surface 111 of the face 112. In one embodiment, the hollow center cavity 106 may be filled with air. However, in other embodiments, the head 102 could be filled with another material, such as a foam. In still further embodiments, the solid materials of the head may occupy a greater proportion of the volume, and the head may have a smaller cavity or no inner cavity at all. It is understood that the inner cavity 106 may not be completely enclosed in some embodiments.

The face 112 is located at the front 124 of the head 102, and has an outer ball striking surface 110 located thereon and the rear surface 111 opposite the ball striking surface 110. The ball striking surface 110 is configured to face a ball in use, and is adapted to strike the ball when the device 100 is set in motion, such as by swinging. As shown, the ball striking surface 110 occupies most of the face 112. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the embodiment shown in FIGS. 1-5, the ball striking surface 110 is inclined slightly (i.e., at a loft angle), to give the ball slight lift and/or spin when struck. In other embodiments, the ball striking surface 110 may have a different incline or loft angle, to affect the trajectory of the ball. Additionally, the face 112 may have one or more internal or external inserts in some embodiments.

Figure 6:
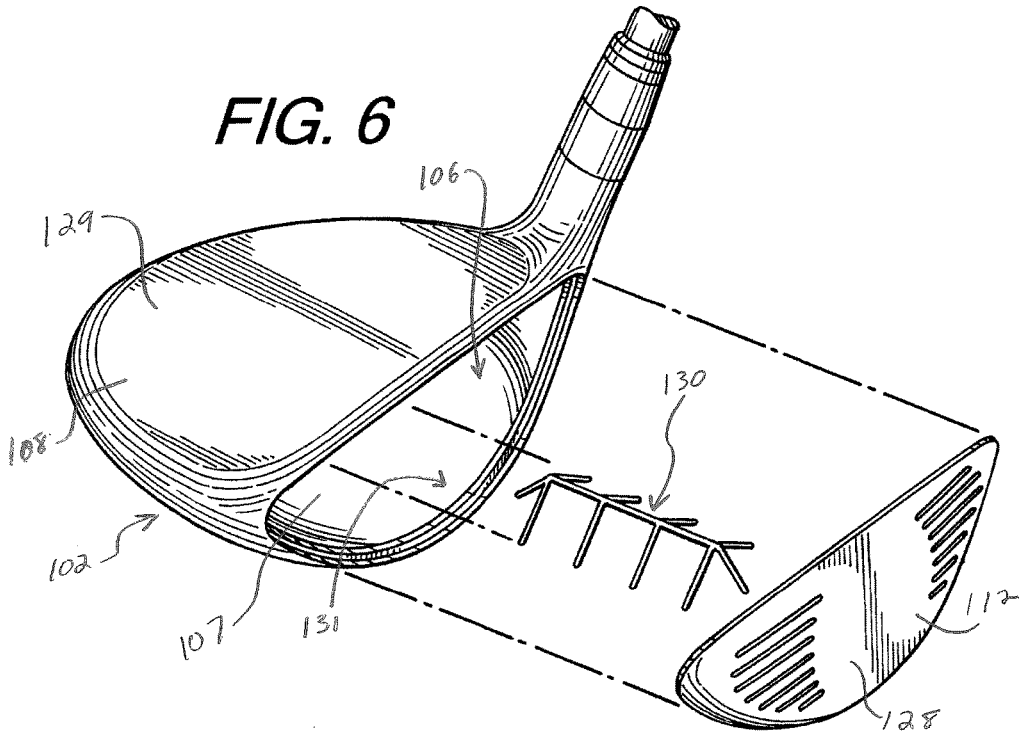
FIG. 6 is an exploded view of the head of FIG. 2, illustrating assembly.
Figure 7:
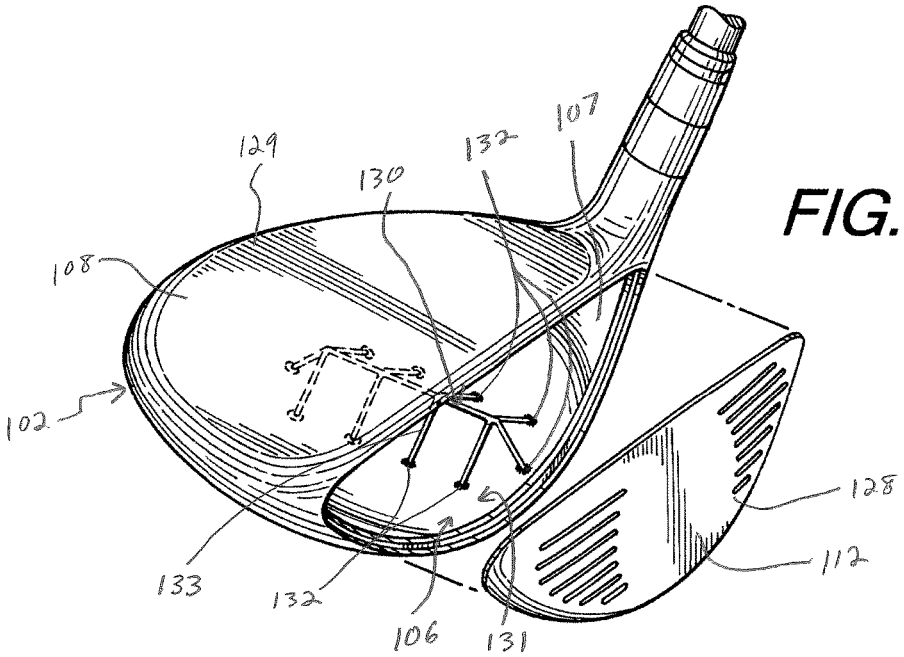
FIG. 7 is another exploded view of the head of FIG. 2, illustrating assembly.

It is understood that the face 112, the body 108, and/or the hosel 109 can be formed as a single piece or as separate pieces that are joined together. In one embodiment, the face 112 is formed from a plate-like face member 128, such as shown in FIGS. 6-7, The body 108 can be formed as a separate piece or pieces joined to the face member 128 by an integral joining technique, such as welding, cementing, or adhesively joining. In the embodiment illustrated in FIGS. 1-5, the body 108 is at least partially formed by a body member 129 that is connected to the face member 128 and extends rearwardly from the face member 128. Other known techniques for joining these parts can be used as well, including many mechanical joining techniques, such as releasable mechanical engagement techniques. If desired, the hosel 109 may be integrally formed as part of the body member 129. In another embodiment, the face 112 may be formed as a cup-face member (not shown) with a wall or walls extending transverse and rearward from the edges of the face 112, and the body member may be connected to the wall(s).

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has a bracing member 130 connected to the interior surface of the head 102 within the internal cavity 106, such as an inner surface 107 of the body 108 and/or the rear face surface 111, which provides at least localized reinforcement of the head 102 and/or deadens sound from impacts on the face 112. In the embodiment shown in FIGS. 1-5, the head 102 has the bracing member 130 located on an inner or upper surface 131 of the sole 118, which may be referred to herein as an inner or upper sole surface 131. In other embodiments, the bracing member 130 may be located on one or more different portions of the interior surface of the head 102, such as described below and shown in FIGS. 22-26. The bracing member 130 has a plurality of ends 132 connected at a plurality of spaced points on the upper sole surface 131 and a bridge portion 133 extending between the ends 132. The bridge portion 133 extends upward from the upper sole surface 131 and is spaced from the upper sole surface 131. In one embodiment, the entire bridge portion 133 is spaced from the upper sole surface 131 between the ends 132. In another embodiment, at least a central portion of the bridge member 133 is spaced from the upper sole surface 131. The plurality of ends 132 may include at least a first end 132 connected to a first point or location on the upper sole surface 131, a second end 132 connected to a second point or location on the upper sole surface 131 that is spaced from the first point, and a bridge portion 133 extending between the first and second ends 132. In the head 102 shown in FIGS. 1-5, any two of the ends 132 of the bracing member 130 may constitute the "first end" and "second end" in the above example, as all the ends 132 are connected at points that are spaced from each other, and the bridge portion 133 interconnects all of the ends 132.

The bracing member 130 may take different forms in different embodiments. In the embodiment of FIGS. 1-5, the bracing member 130 is formed of a plurality of beams or trusses 134 that form a frame of the bracing member 130. Some of the trusses 134 have lower ends 132 connected to the upper sole surface 131 and extend upward from the upper sole surface 131 to form portions of the bridge portion 133. Such trusses 134 may be referred to herein as legs 135, and have distal ends 136 (opposite the ends 132) that may be joined to other trusses 134. Additionally, some of the trusses 134 are spaced from the upper sole surface 131 and interconnect with other trusses 134. Such trusses 134 may be referred to herein as branches or connecting trusses 137, and may be connected to the distal ends 136 of one or more of the legs 135 and may interconnect two or more of the legs 135.

In the embodiment shown in FIGS. 1-5, the connecting trusses 137 form a spine or spine member 138 that interconnects all of the legs 135 and is elongated in the direction extending from the front 124 to the rear 126 of the head 102. The spine 138 has a plurality of legs 135 extending outwardly and downwardly therefrom, such that each of the legs 135 has its distal end 136 connected to the spine 138 and its respective lower end 132 connected to a point on the upper sole surface 131. It is understood that the bracing member 130 of FIGS. 1-5 is described as having multiple connecting trusses 137 forming a single spine 138, however the bracing member 130 may alternately be considered to have a single, extended connecting truss 137 or multiple, connected spines 138. The head 102 of FIGS. 1-5 has trusses 134 that form ten legs 135 depending from the spine 138, with eight of the legs 135 arranged in four pairs that extend from opposite sides of the spine 138 at four spaced locations on the spine 138, with each leg 135 of a pair connected to the same location on the spine 138. Two of the pairs of legs 135 are positioned at opposite ends of the spine 138 in the embodiment shown in FIGS. 1-5. The distal ends 136 of the legs 135 of each pair may be considered to be joined or connected together, as well as connected to the connecting trusses 137 forming the spine 138. The remaining two legs 135 extend from opposite ends of the spine 138. It is understood that while the spine 138 is straight in FIGS. 1-5, in another embodiment, the head 102 may have a spine 138 that is curved, angled, jointed, etc.

Figure 4:
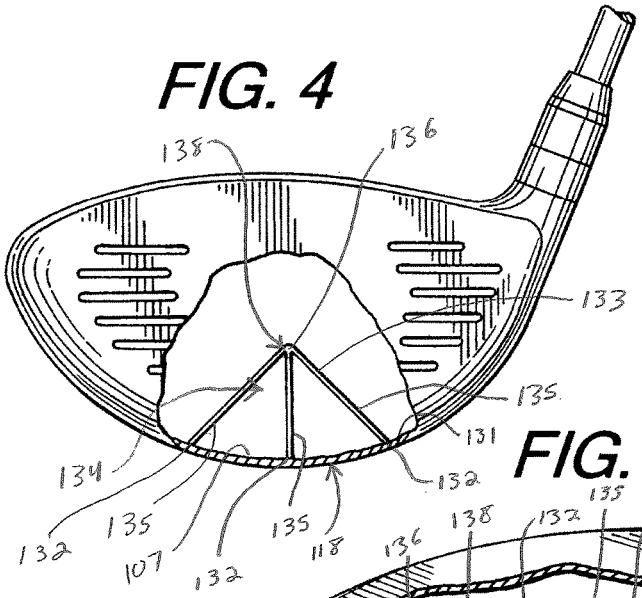
FIG. 4 a broken-away front view of the head of FIG. 2, showing internal detail.
Figure 3:
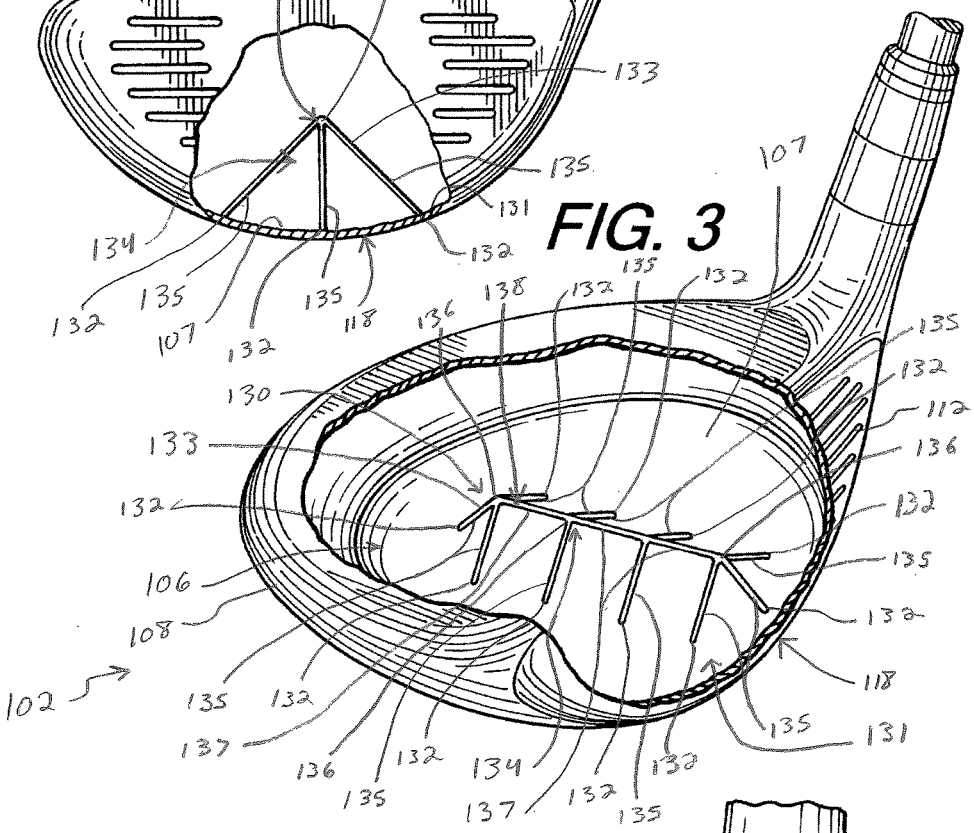
FIG. 3 a broken-away perspective view of the head of FIG. 2, showing internal detail.
Figure 5:
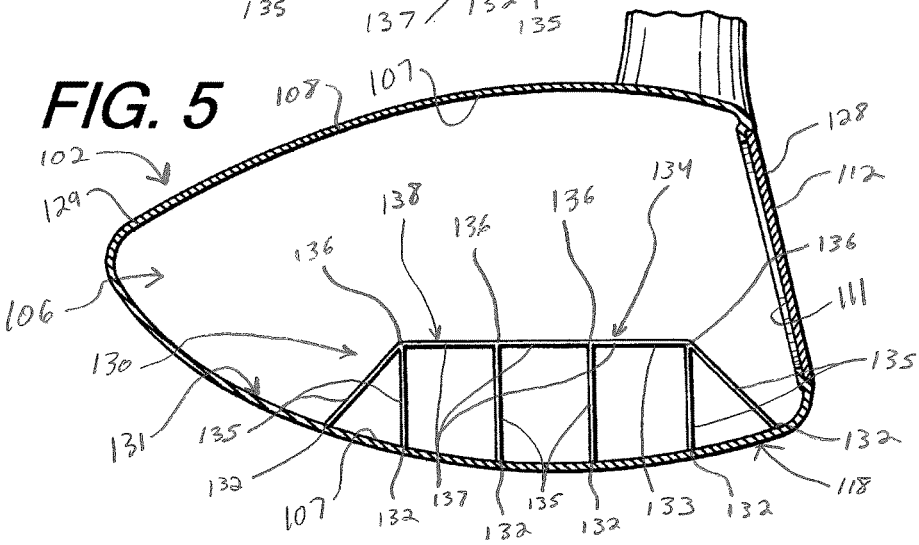
FIG. 5 a cross-sectional view of the head of FIG. 2.

In the embodiment shown in FIGS. 1-5, the bridge portion 133 defines a generally triangular shape or profile when viewed from the front 124 or the rear 126 of the head 102. As seen in FIG. 4, the first pair of legs 135 of the bracing member 130 combine with the upper sole surface 131 to form a triangular or generally triangular shape, where the lower ends 132 of the legs 135 form two corners of the shape, and the combined connected distal ends 136 of the legs 135 form the third corner. The spine 138 may also be considered to form the third corner. The legs 135 and the upper sole surface 131 form the three sides, with the upper sole surface 131 forming a curvilinear side in this embodiment. The second, third, and fourth pairs of legs 135 similarly combine with the upper sole surface 131 to define a generally triangular shape. Further, as seen in FIGS. 4-5, the legs 135 at the ends of the spine 138 each combine with either of the legs 135 of the adjacent pair to form generally triangular shapes. Other triangular shapes may be identifiable as well. In another embodiment, the bridge portion 133 may define a different shape, including any of a variety of arched shapes, such as a smooth arc (see FIGS. 14-15), a square, a trapezoid, etc. Additionally, the bridge portion 133 may define different shapes when viewed from different angles. For example, the bridge portion 133 defines both a generally rectangular shape and a generally trapezoidal shape when viewed from the toe 122, as illustrated in FIG. 5.

The bracing member 130 may be formed of one or more materials, and a variety of such materials may be used in forming the bracing member. Such materials include metals (e.g. titanium, stainless or other steels, aluminum, etc.) including alloys thereof, polymers, composites (e.g. carbon-fiber composites), or other materials. The materials and design of the bracing member 130 may be selected to minimize weight if desired, so as to minimize the effect of the bracing member 130 on the total mass of the head 102 and allow strategic location of as much mass as possible. Alternately, the mass of the bracing member 130 may be used to add weight to an area of the head 102, in order to achieve strategic weighting, such as locating the CG and/or affecting MOI. In one embodiment, the bracing member 130 may be made from titanium or titanium alloy. Additionally, the trusses 134 of the bracing member 130 may be connected to each other in a variety of different manners, and may also be connected to the body 108 in a variety of different manners. Techniques for such joining include: welding; integral forming, such as being formed of a single piece (e.g. by casting, molding, forging, machining, or other techniques); adhesives or other bonding materials; mechanical joints or fasteners, such as balls or blocks that may be welded to the ends of the trusses 134, drilled with holes for threading or interference fit on the ends 136 of the trusses 134, etc.; or other joining techniques. The joining techniques may at least partially depend on the materials of the bracing member 130.

The head 102 of FIGS. 1-5 may be strategically weighted in conjunction with the bracing member 130, as the weight of any bracing member(s) 130 connected to the head may require weight removal in other areas of the head 102 in order for the head 102 to remain within permissible weight ranges, such as a prevailing maximum weight set by the USGA. Additionally, the weight of the bracing member 130 itself may affect the center of gravity, weight distribution, and/or moment of inertia of the head 102. Accordingly, the structure of the bracing member 130 may be altered for weighting purposes. For example, the bracing member 130 may be designed to be heavier in the front, back, or either side by using heavier or thicker trusses 134 to create weight in one portion and lighter or thinner trusses to reduce weight in other portions. The size, spread, structure, orientation, and other features of the bracing member 130 may be adjusted to affect the weighting of the head 102 in various embodiments, and unique weighting configurations can thereby be achieved.

FIGS. 6-7 illustrate one method of constructing the head 102 as shown in FIGS. 1-5, by connecting the bracing member 130 to the body 108 by welding. As shown in FIG. 6, the bracing member 130 is inserted into the cavity 106 of the body member 129 before the face member 128 is connected to the body member 129. The bracing member 130 is then connected to the upper sole surface 131 of the body member 129 by welding each of the ends 132 of the trusses 134 to the upper sole surface 131, as shown in FIG. 7. The face member 128 can then be connected to the body member 129 illustrated in FIG. 7. This method or a similar method may be used to connect the bracing member 130 to a head 102 with a face member 128 and/or a body member 129 that is differently configured, such as the configurations as described above. Further, in another embodiment, a different portion of the face 112 and/or the body 108 may be removable to allow access to the cavity 106 to insert the bracing member 130. Similar methods can be used for connecting the bracing members 230, et seq., shown in FIGS. 8-15 and 18-21 to their respective heads 202, et seq. As described above, other connection techniques may be used in other embodiments.

Figure 15:
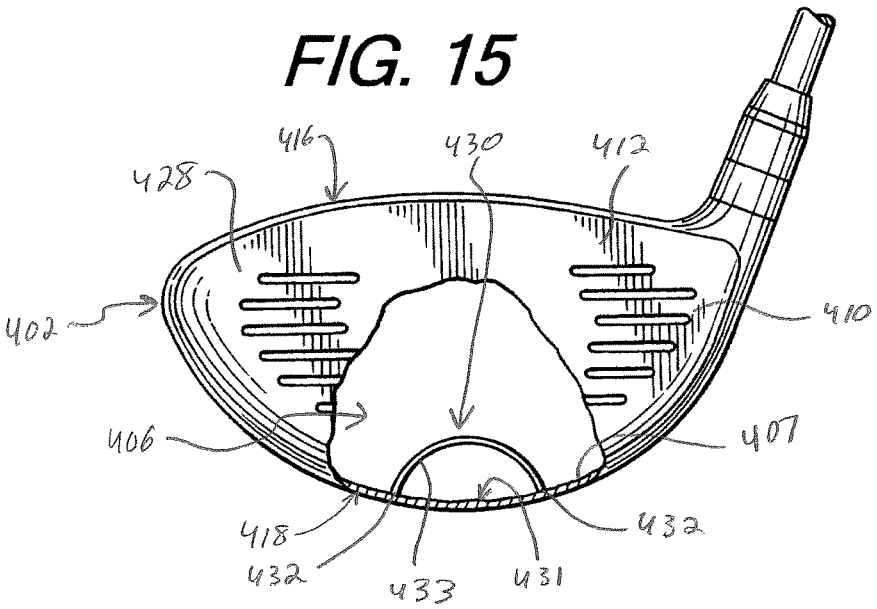
FIG. 15 a broken-away front view of the head of FIG. 8, showing internal detail.
Figure 16:
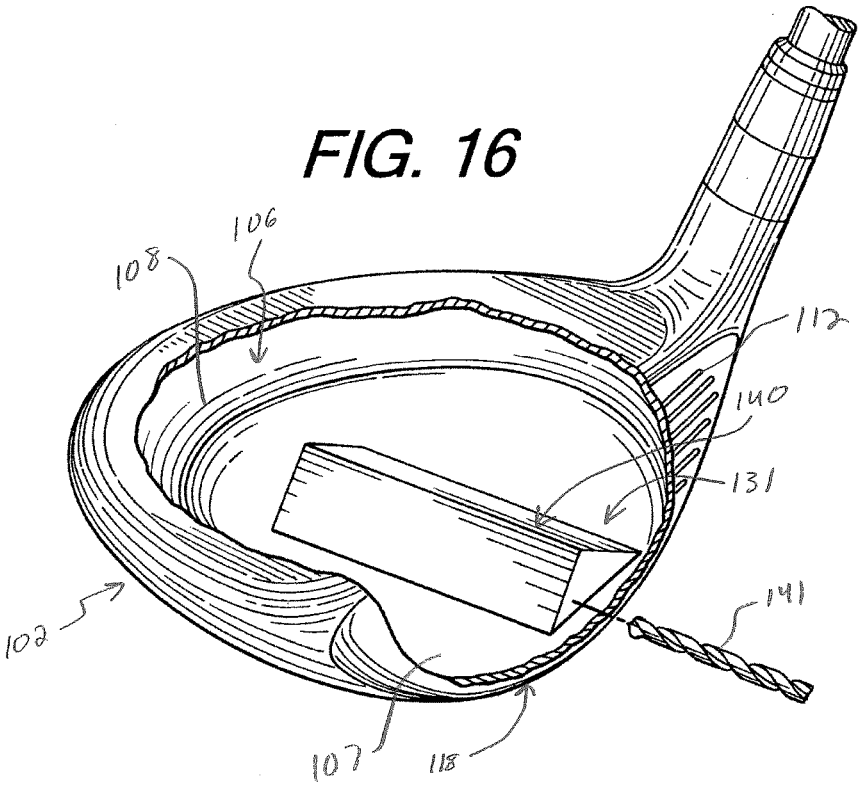
FIG. 16 is a schematic, broken-away perspective view of a method for creating a head of a ball-striking device as shown in FIG. 2.
Figure 17:
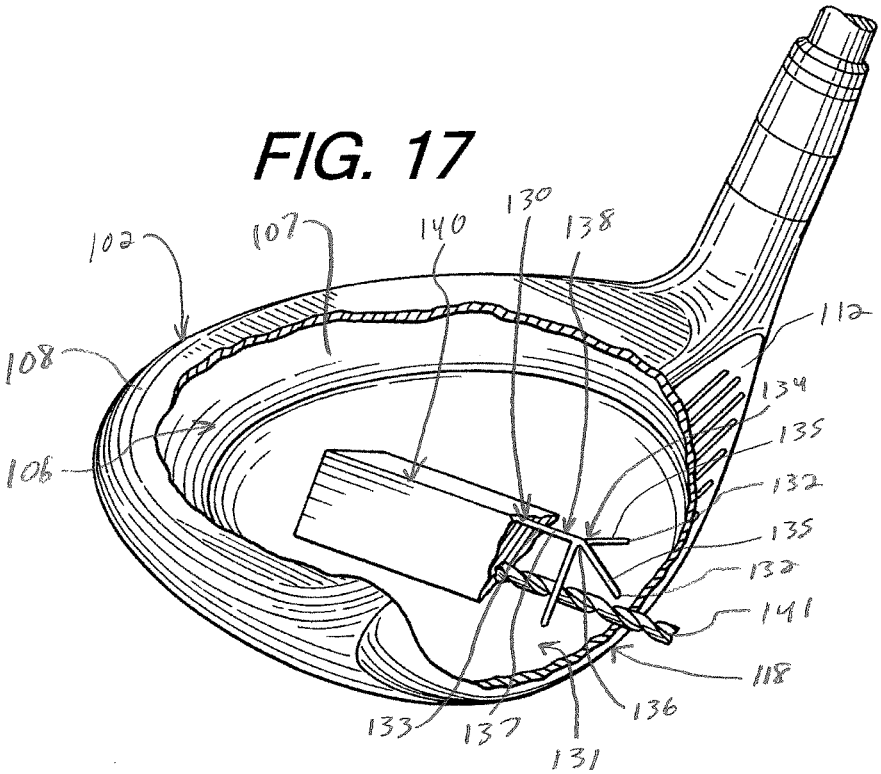
FIG. 17 is a schematic, broken-away perspective view of the method of FIG. 16, shown in a partially complete state.
Figure 18:
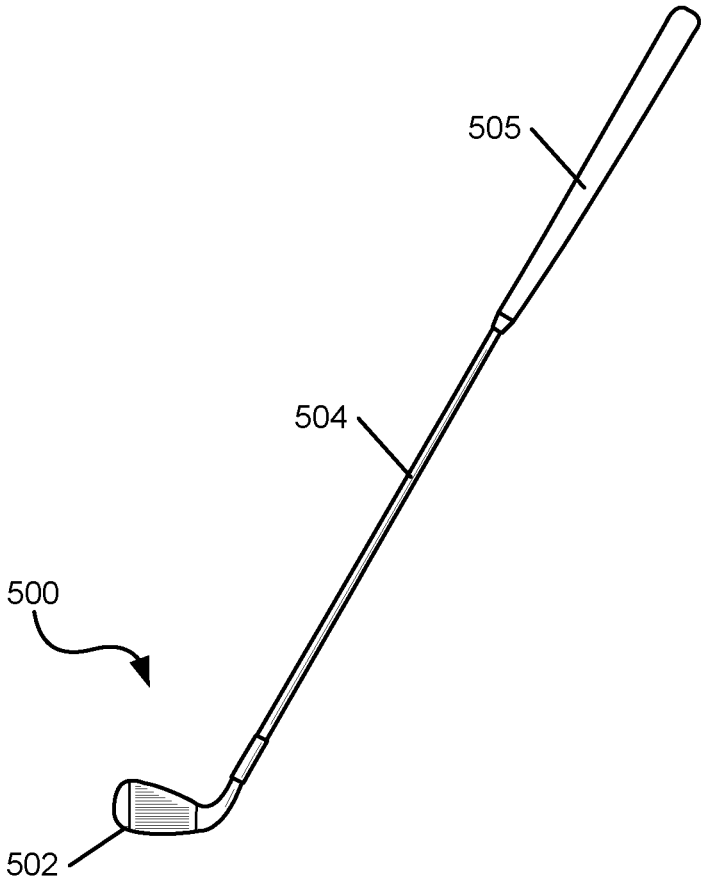
FIG. 18 is a front view of another embodiment of a ball striking device according to aspects of the invention, in the form of an iron-type golf club.
Figure 19:
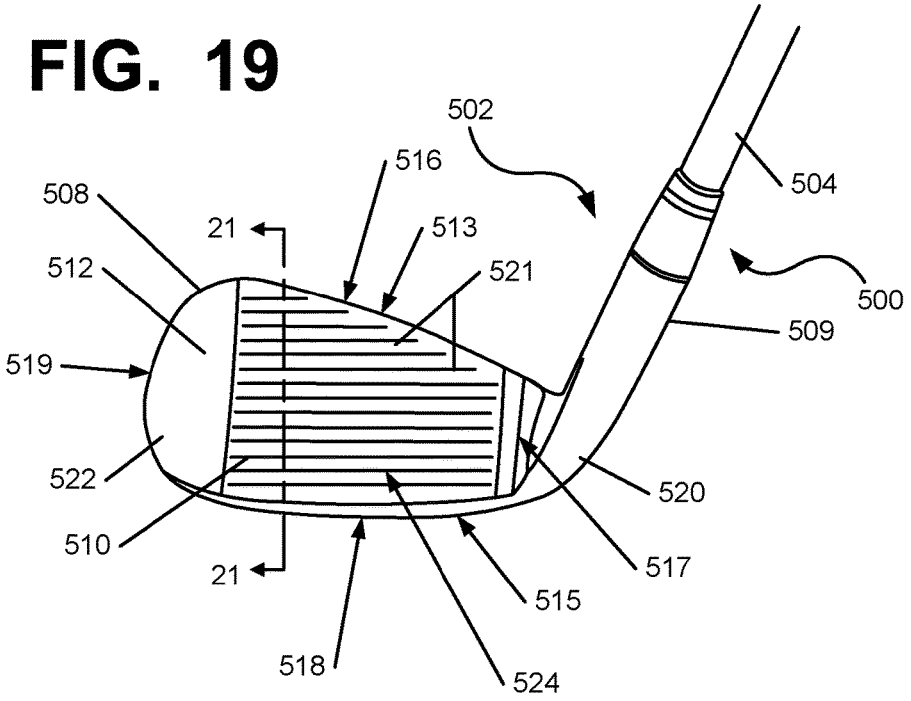
FIG. 19 is a front view of a head of the ball striking device of FIG. 18.

FIGS. 16-17 illustrate a method for integrally forming a bracing member 130 with the body 108 of a head 102 as illustrated in FIGS. 1-5, using machining or other material removal technique. As shown in FIG. 16, the body member 129 is formed with a block 140 of material integrally connected to the upper sole surface 131 and extending upwardly from the upper sole surface 131. The block 140 is then machined, such as by use of a tool 141 as shown in FIG. 17, to remove material from the block 140, creating a bracing member 130 as described above and illustrated in FIGS. 1-5. The face member 128 can then be connected to the body member 129 illustrated in FIG. 17. This method or a similar method may be used to integrally form the bracing member 130 with a head 102 having a face member 128 and/or a body member 129 that is differently configured, such as the configurations as described above. In another embodiment, a different portion of the face 112 and/or the body 108 may be removable to allow access to the cavity 106 to machine the block 140. Similar methods can be used for integrally forming the bracing members 230, et seq., shown in FIGS. 8-15 and 18-21 with their respective heads 202, et seq. As described above, other integral forming techniques may be used in other embodiments.

FIGS. 8-15 illustrate various other embodiments of ball striking devices 200, 300, 400 and ball striking heads 202, 302, 402 in the form of wood-type golf clubs, having different configurations with differently-configured bracing members. Each of these configurations can be used in connection with a ball striking device, such as the ball striking device 100 as shown in FIGS. 1-5, or various other configurations for ball striking devices within the scope of the present invention, additional examples of which are shown herein. Thus, common features of the head 102 and the heads 202, 302, 402, described below and illustrated in FIGS. 8-15 are referred to with similar reference numbers used to describe the head 102 of FIGS. 1-5, using different series (e.g. 2xx, 3xx, 4xx) of reference numbers.

FIGS. 8-10 illustrate another embodiment of a ball striking head 202 for a ball striking device 200 in the form of a wood-type golf club. In this embodiment, the head 202 includes a plurality of bracing members 230 connected to the upper sole surface 231 of the body 208, with each bracing member 230 having ends 232 connected to the upper sole surface 231 and a bridge portion 233 that is spaced from the upper sole surface 231 between the ends 232. Each bracing member 230 includes a plurality of trusses 234 extending upward from the upper sole surface 231, each truss having a lower end 232 connected to the upper sole surface 231 and distal ends 236 opposite the lower end 232. As shown in FIGS. 8-10, each bracing member 230 includes four trusses 234 in the form of legs extending downward and outward from a juncture, with the four distal ends 236 of the trusses 234 connected to each other at the juncture. As seen in FIG. 9, the bracing members 230 are separate from each other, and are symmetrically aligned in a row along the upper sole surface 231. Additionally, each of the bracing members 230 defines a generally triangular shape, as similarly described above, when viewed from the front 224 or rear 226 of the head 202 (see FIG. 8), or when viewed from the heel 220 or toe 222 of the head 202 (see FIG. 10). In other embodiments, the head 202 may have a different number of bracing members 230, and the bracing members 230 may be differently configured, oriented, and/or located on the body 208.

FIGS. 22-26 illustrate additional embodiments of ball striking heads 202A-E for a ball striking device 200 in the form of a wood-type golf club. In each of these embodiments, the head 202A-E includes one or more bracing members 230 constructed similarly to the bracing members 230 in FIGS. 8-10, and the components of the heads 202A-E in FIGS. 22-26 utilize the reference numbers of FIGS. 8-10 to refer to the same components. Each bracing member 230 in FIGS. 22-26 includes a plurality of trusses 234 extending from the ends 232, with each truss having a lower end 232 connected to the interior surface of the head 202A-E and distal ends 236 opposite the lower end 232. As described above, each bracing member 230 includes four trusses 234 in the form of legs extending downward and outward from a juncture, with the four distal ends 236 of the trusses 234 connected to each other at the juncture. Additionally, each of the bracing members 230 defines a generally triangular shape, as similarly described above, when viewed from the side. In other embodiments, the head 202A-3 may have a different number of bracing members 230, and the bracing members 230 may be differently configured, oriented, and/or located on the body 208. For example, the heads 202A-E in FIGS. 22-26 may include bracing members configured according to another embodiment described herein and positioned in the locations shown in FIGS. 22-26. Each of the embodiments in FIGS. 22-26 is described in greater detail below.

Figure 22:
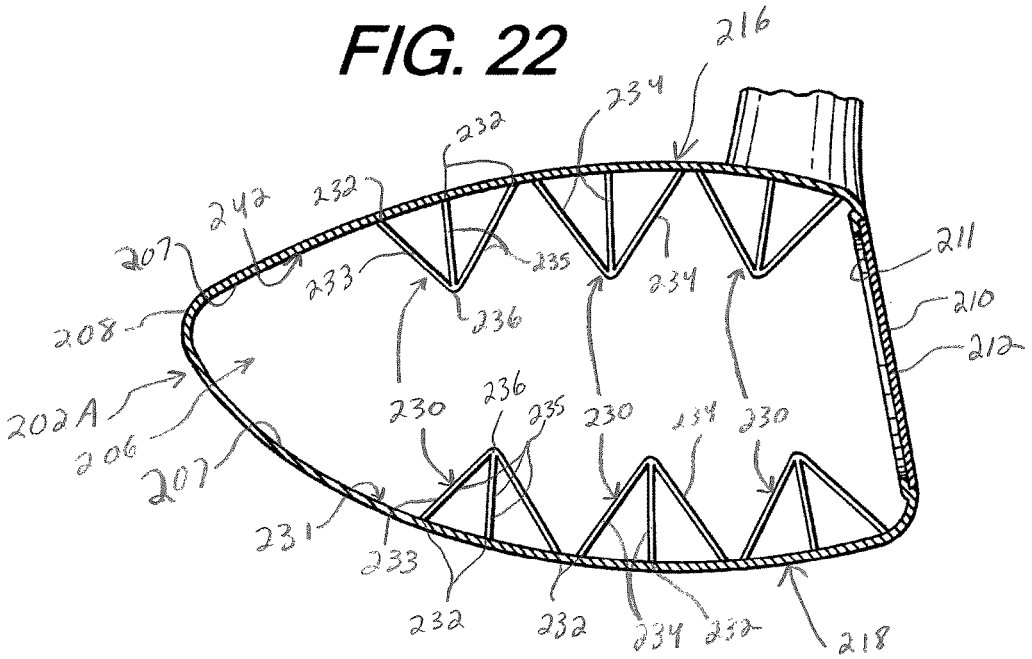
FIG. 22 is a cross-section view of another embodiment of a ball-striking device according to aspects of the invention, in the form of a wood-type golf club head, showing internal detail.

In the embodiment of FIG. 22, the head 202A includes a plurality of bracing members 230 connected to a lower crown surface 242 of the body 208, with each bracing member 230 having ends 232 connected to the lower crown surface 242 and a bridge portion 233 that is spaced from the lower crown surface 242 between the ends 232. The head 202A also includes a plurality of bracing members 230 connected to the upper sole surface 231 of the body 208, as described above and shown in FIGS. 8-10. As described with respect to FIGS. 8-10, the bracing members 230 are separate from each other and are symmetrically aligned in a row. The bracing members 230 in this embodiment provide at least localized reinforcement of both the crown 216 and sole 218 and/or deaden sound from impacts on the face 212.

Figure 23:
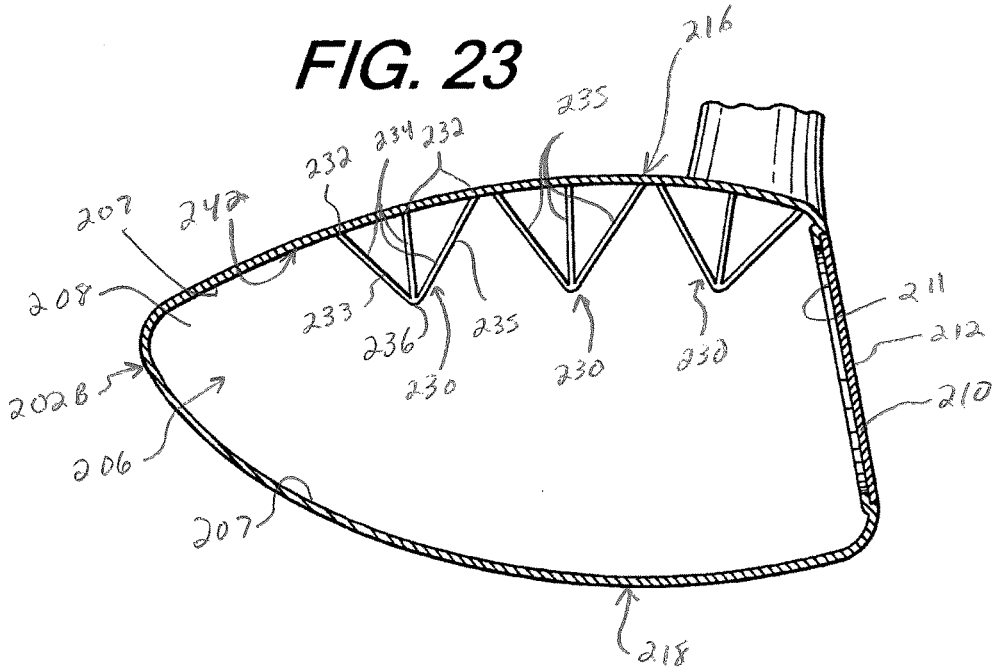
FIG. 23 is a cross-section view of another embodiment of a ball-striking device according to aspects of the invention, in the form of a wood-type golf club head, showing internal detail.

In the embodiment of FIG. 23, the head 202B includes a plurality of bracing members 230 connected to an inner or lower surface 242 of the crown 216, which may be referred to herein as an inner or lower crown surface 242. Each bracing member 230 has ends 232 connected to the lower crown surface 242 and a bridge portion 233 that is spaced from the lower crown surface 242 between the ends 232. As described with respect to FIGS. 8-10, the bracing members 230 are separate from each other and are symmetrically aligned in a row. The bracing members 230 in this embodiment provide at least localized reinforcement of the crown 216 and/or deaden sound from impacts on the face 212.

Figure 24:
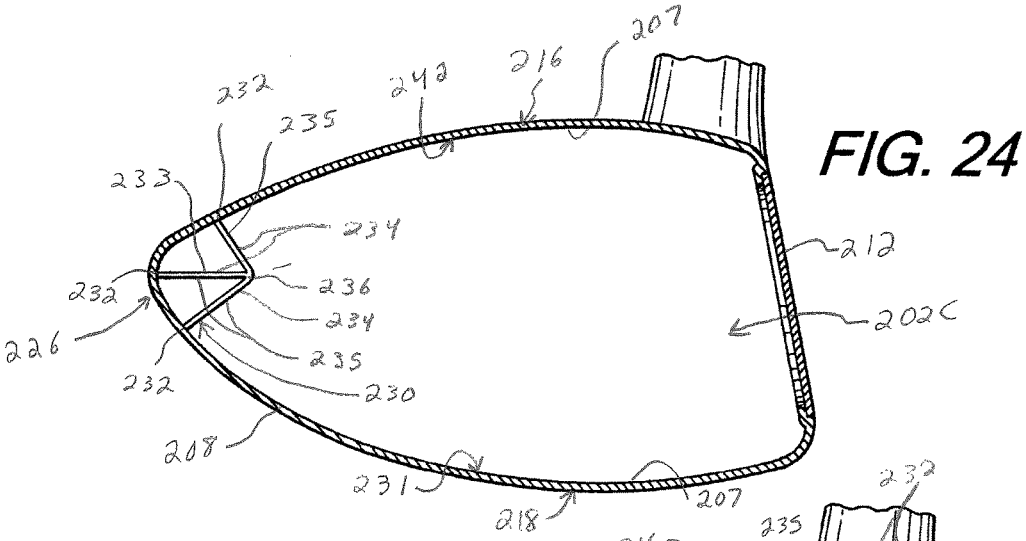
FIG. 24 is a cross-section view of another embodiment of a ball-striking device according to aspects of the invention, in the form of a wood-type golf club head, showing internal detail.

In the embodiment of FIG. 24, the head 202C includes a bracing member 230 connected to the inner surface at the rear 226 of the head 202C, and contacts both the lower crown surface 242 and the upper sole surface 231 of the body 208. The bracing member 230 has ends 232 connected to the lower crown surface 242 and to the upper sole surface 231, as well as a bridge portion 233 that is spaced from the inner surface of the body 208 between the ends 232. The bracing member 230 in this embodiment provides at least localized reinforcement of the rear 226 of the head 202C and/or deadens sound from impacts on the face 112.

Figure 25:
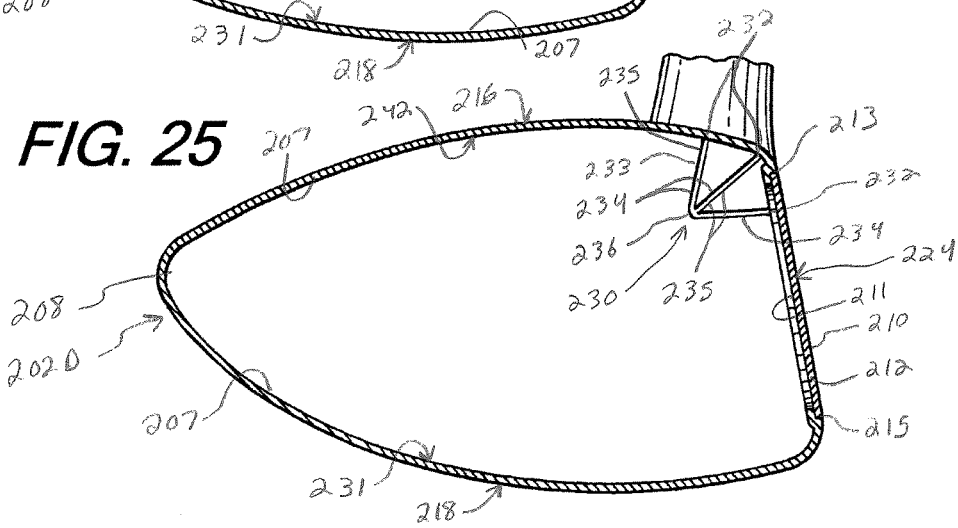
FIG. 25 is a cross-section view of another embodiment of a ball-striking device according to aspects of the invention, in the form of a wood-type golf club head, showing internal detail.

In the embodiment of FIG. 25, the head 202D includes a bracing member 230 connected to the inner surface at the front 224 of the head 202D, and contacts both the lower crown surface 242 of the body 208 and the rear or inner surface 211 of the face 212. The bracing member 230 has ends 232 connected to the lower crown surface 242 and to the rear face surface 211 proximate the top edge 213 of the face 212, as well as a bridge portion 233 that is spaced from the inner surfaces of the head 202D between the ends 232. The bracing member 230 in this embodiment provides at least localized reinforcement of the crown 216 and the face 212 and/or deadens sound from impacts on the face 212.

Figure 26:
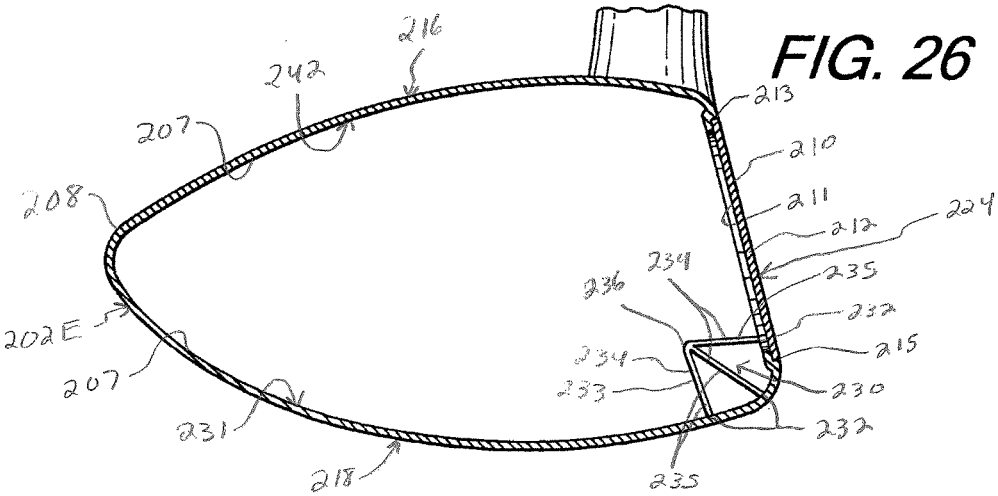
FIG. 26 is a cross-section view of another embodiment of a ball-striking device according to aspects of the invention, in the form of a wood-type golf club head, showing internal detail.

In the embodiment of FIG. 26, the head 202E includes a bracing member 230 connected to the inner surface at the front 224 of the head 202E, and contacts both the upper sole surface 231 of the body 208 and the rear or inner surface 211 of the face 212. The bracing member 230 has ends 232 connected to the lower crown surface 242 and to the rear face surface 211 proximate the bottom edge 215 of the face 212, as well as a bridge portion 233 that is spaced from the inner surfaces of the head 202E between the ends 232. The bracing member 230 in this embodiment provides at least localized reinforcement of the sole 218 and the face 212 and/or deadens sound from impacts on the face 212.

FIGS. 11-13 illustrate another embodiment of a ball striking head 302 for a ball striking device 300 in the form of a wood-type golf club. In this embodiment, the head 302 includes a bracing member 330 connected to the upper sole surface 331 of the body 308, including a plurality of trusses 334 extending upward from the upper sole surface 331 to form a bridge portion 333. The trusses 334 have ends 332 connected to the upper sole surface 331 and distal ends 336 opposite the ends 332. As shown in FIGS. 11-13, the bracing member 330 includes four pairs of legs 335 extending downward and outward from a spine 338 that is spaced from the upper sole surface 331, with the distal ends 336 of each pair of legs 335 connected to each other and connected to opposite sides of the spine 338 similarly to the bracing member 130 of FIGS. 1-5. The bracing member 330 also includes an additional leg 335 extending downward from one end of the spine 338, and another truss in the form of a wall 339 extending downward from the underside of the spine 338 to the upper sole surface 331. The wall 339 has an elongated end 332 that is connected to the upper sole surface 331 along a line that extends between the front 324 and the rear 326 of the head 302. Additionally, the bracing member 330 defines a generally triangular shape, as similarly described above, when viewed from the front 324 or rear 326 of the head 302, as seen in FIG. 11. In other embodiments, the head 302 may have a bracing member 330 that may be differently configured, oriented, and/or located on the body 308. For example, in other embodiments, the bracing member 330 may have multiple walls 339 or an intermittent wall 339 extending downward from the spine 338, or the wall 339 may be differently shaped or oriented.

Figure 14:
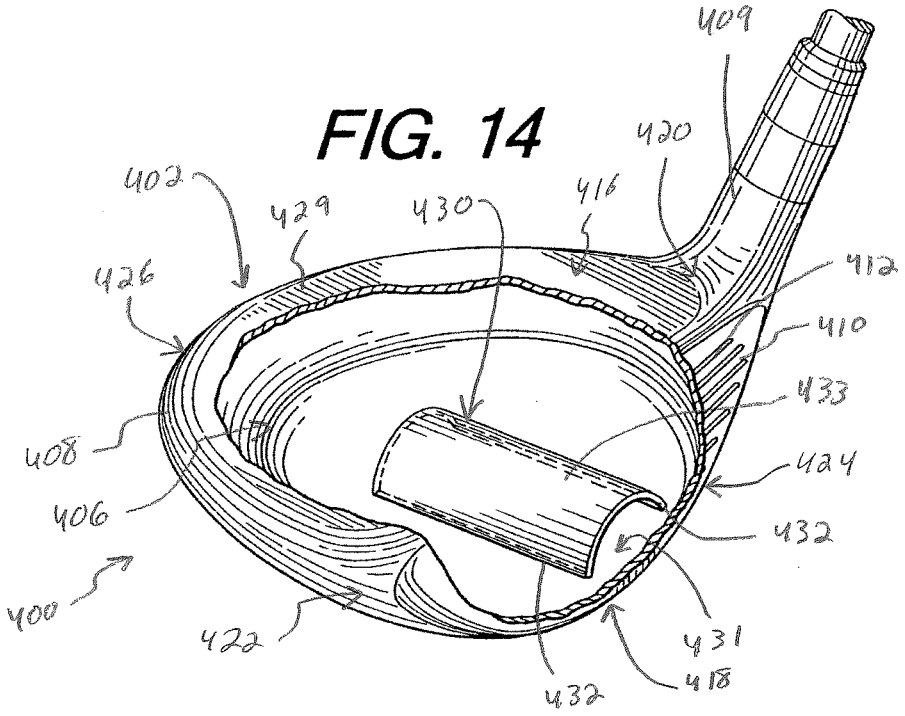
FIG. 14 is a broken-away perspective view of another embodiment of a ball-striking device according to aspects of the invention, in the form of a wood-type golf club head, showing internal detail.

FIGS. 14-15 illustrate another embodiment of a ball striking head 402 for a ball striking device 400 in the form of a wood-type golf club. In this embodiment, the head 402 includes a bracing member 430 connected to the upper sole surface 431 of the body 408, having ends 432 connected to the upper sole surface 431 and a bridge portion 433 between the ends 432 that is spaced from the upper sole surface 431. In this embodiment, the bridge portion 433 is in the form of an semi-cylindrical (i.e. arc-shaped) arch extending upward from the ends 432 and being spaced from the upper sole surface 431 between the ends 432. The ends 432 are connected to the upper sole surface 431 along lines that are spaced from each other and extend in a direction between the front 424 and the rear 426 of the head 402. It is understood that the ends 432 may each be considered to be connected to a point on the upper sole surface 431, as each end 432 is connected along a line that includes the point. In other embodiments, the head 402 may have a bracing member 430 that is differently configured, oriented, and/or located on the body 408. For example, the arch may have a different cross-sectional shape (e.g. square or triangular), or may have slots or gaps in the walls thereof. Further embodiments are contemplated.

FIGS. 18-21 illustrate a ball striking device 500 in the form of a golf iron, in accordance with at least some examples of this invention. The embodiment of the iron-type ball striking device 500 illustrated in FIGS. 18-21 contains features similar to those of the embodiments described above with respect to FIGS. 1-17, and similar components in the embodiment of FIGS. 18-21 are similarly referred to using the "5xx" series of reference numbers. It is understood that discussion of some features of the embodiment of FIGS. 18-21 that have already been described above may be reduced or eliminated in the interests of brevity. The ball striking device 500 includes a golf club head 502 and a shaft 504 attached to the head 502. The golf club head 502 of FIGS. 18-21 may be representative of any iron-type golf club head in accordance with examples of the present invention.

As shown in FIGS. 18-21, the golf club head 502 includes a face 512 connected to a body 508 and a hosel 509 extending from the body 508 for attachment of the shaft 504. The shaft 504, and the connection between the shaft 504 and the hosel 509 may be similar to that described above with respect to the device 100 of FIGS. 1-5. The shaft 504 may also include a grip 505 as described above. For reference, the head 502 generally has a top 516, a bottom or sole 518, a heel 520 proximate the hosel 509, and a toe 522 distal from the hosel 509, as well as a front 524 and a back or rear 526. In the embodiment shown, the face 512 extends upward from the sole 518 of the head 502. The shape and design of the head 502 may be partially dictated by the intended use of the device 500. The heel portion 520 is attached to and/or extends from a hosel 509 (e.g., as a unitary or integral one piece construction, as separate connected elements, etc.).

The face 512 is located at the front 524 of the head 502, and has a ball striking surface 510 located thereon and a rear or inner surface 511 (See FIG. 21) opposite the ball striking surface 510. The head 502 has a rear cavity 506 that is defined by the rear surface 511 of the face 512, one or more walls 525 extending rearward from the face 512. In other embodiments, the head 502 may also have a rear wall (not shown) extending upward from the sole 518 at the rear 526 of the head 502 that partially or completely encloses the rear cavity 506, or may have no internal cavity (e.g. a blade-type iron).

The ball striking surface 510 is typically an outer surface of the face 512 configured to face a ball (not shown) in use, and is adapted to strike the ball when the device 500 is set in motion, such as by swinging. As shown, the ball striking surface 510 is relatively flat, occupying most of the face 512. The ball striking surface 510 may include grooves 521 (e.g., generally horizontal grooves 521 extending across the face 512 in the illustrated example) for the removal of water and grass from the face 512 during a ball strike. Of course, any number of grooves, desired groove patterns, and/or groove constructions may be provided (or even no groove pattern, if desired), including conventional groove patterns and/or constructions, without departing from this invention. The face 512 may include some curvature in the top to bottom and/or heel to toe directions (e.g., bulge and roll characteristics), as is known and is conventional in the art. In other embodiments, the surface 510 may occupy a different proportion of the face 512, or the body 508 may have multiple ball striking surfaces 510 thereon. In the illustrative embodiment shown in FIGS. 18-21, the ball striking surface 510 is inclined (i.e., at a loft angle), to give the ball an appreciable degree of lift and spin when struck. In other illustrative embodiments, the ball striking surface 510 may have a different incline or loft angle, to affect the trajectory of the ball. Additionally, the face 512 may have a variable thickness and/or may have one or more internal or external inserts in some embodiments.

The face 512, the body 508, and/or the hosel 509 can be formed as a single piece or as separate pieces that are joined together. For example, the face 512, the body 508, and the hosel 509 can be formed together as a single piece by forging, casting, or other integral forming techniques. As another example, the face 512, the body 508, and the hosel 509 can be formed as separate pieces, such as a face member and a body member, which can be joined together by an integral joining technique, such as welding, or other joining technique.

Figure 20:
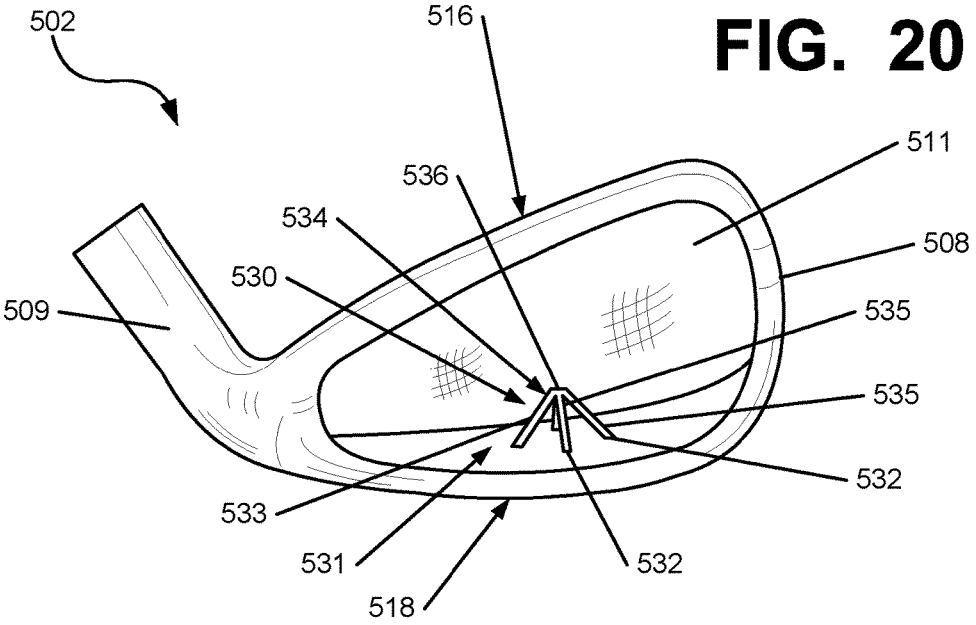
FIG. 20 is a rear view of a head of the ball striking device of FIG. 18.
Figure 21:
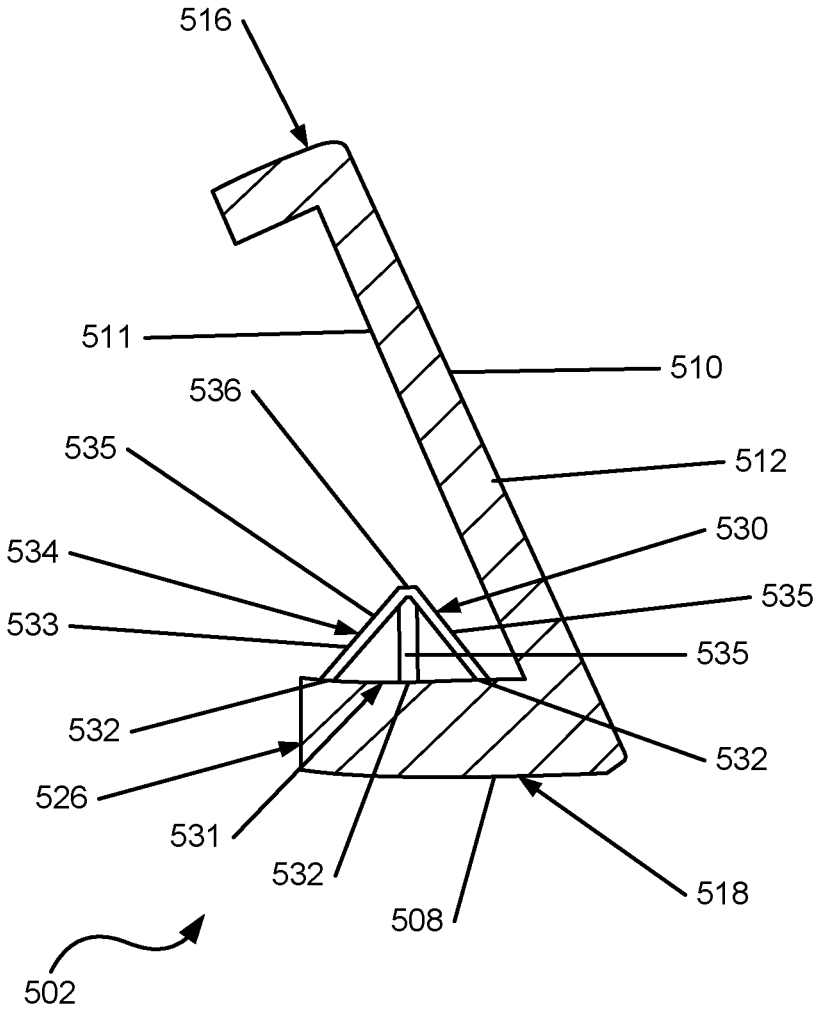
FIG. 21 is a cross-section view taken along lines 21-21 of FIG. 19.

In the embodiment shown in FIGS. 18-21, the head 502 includes a bracing member 530 connected to the upper sole surface 531 of the body 508, having ends 532 connected to the upper sole surface 531 and a bridge portion 533 that is spaced from the upper sole surface 531 that extends between the ends 532. In this embodiment, the bracing member 530 is located in the rear cavity 506 of the head 502, but may be differently positioned in other embodiments, such as if the head 502 has no rear cavity. The bracing member 530 includes a plurality of trusses 534 extending upward from the upper sole surface 531, each truss having a lower end 532 connected to the upper sole surface 531 and distal ends 536 opposite the lower end 532. As shown in FIGS. 20-21, the bracing member 530 is similar to the bracing members 230 of FIGS. 8-10, including four trusses 534 in the form of legs extending downward and outward from a juncture 539, with the four distal ends 536 of the trusses 534 connected to each other at the juncture 539. As seen in FIG. 9, the bracing member 530 defines a generally triangular shape, as similarly described above, when viewed from the front 524 or rear 526 of the head 502 (see FIG. 20), or when viewed from the heel 520 or toe 522 of the head 502 (see FIG. 21). In other embodiments, the bracing member 530 may be differently configured, oriented, and/or located on the body 508, or the head 502 may have multiple bracing members, such as in the embodiment of FIGS. 8-10.

The bracing member 530 in this embodiment can be connected to the head 502 using any of the methods and techniques described above and/or shown in FIGS. 6-7 and 16-17. It is understood that in the embodiment shown in FIGS. 18-21, connection or machining of the bracing member 530 may be performed without removing any component of the head 502, but that in another embodiment without an open rear cavity 506, removal of at least one component may be required.

It is understood that any of the embodiments of ball striking devices 100, et seq., heads 102, et seq., bracing members 130, et seq., and other components described herein may include any of the features described herein with respect to other embodiments described herein, including structural features, functional features, and/or properties, unless otherwise noted. It is understood that the specific sizes, shapes, orientations, and locations of various components of the ball striking devices 100, et seq., and heads 102, et seq., described herein are simply examples, and that any of these features or properties may be altered in other embodiments.

Heads 102, et seq., incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club and/or at least one iron-type club. For example, a set of iron-type golf clubs can be provided, with each club having a different loft angle, and each club having a head 502 as described above and shown in FIGS. 18-21. The various clubs in the set may have bracing members 130, et seq., that may be slightly different in shape, size, location, orientation, etc., based on the loft angle of the club. The various clubs may also have an added weight amount or weight distribution that may be different based on characteristics such as the type and loft angle of the club.

Different bracing members 130, et seq., and different locations, orientations, and connections thereof, may produce different reinforcing effects and have different effects on the resonance of the head. Additionally, different bracing members 130, et seq., and different locations, orientations, and connections thereof, may produce different effects depending on the location of the ball impact on the face 112, et seq. Accordingly, one or more clubs can be customized for a particular user by providing a club with a head as described above, with a bracing member 130, et seq., that is configured in at least one of its shape, size, location, orientation, etc., based on a hitting characteristic of the user, such as a typical hitting pattern or swing speed. Customization may also include adding or adjusting weighting according to the characteristics of the bracing member 130, et seq., and the hitting characteristic(s) of the user. Still further embodiments and variations are possible, including further techniques for customization.

The various embodiments of bracing members described herein can provide at least localized reinforcement of the body. This reinforcing effect can change or affect the resonance of the head, which can deaden or otherwise alter sound from impacts on the face, improve the feel of the impact for the user, and/or increase energy and velocity transferred during impact through reduced vibrational damping. Additionally, weighting created by the bracing member(s) and/or used in conjunction with the bracing member(s) can create unique weighting configurations. Further, the bracing member(s) can provide reinforcement to potential failure points on the head. This, in turn, permits portions of the head to be made from thinner materials, which can increase energy transfer and ball velocity. Areas made of such thinner material can be more prone to failure, and the bracing member(s) can reinforce such areas to resist failure. Still further benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having an outer surface configured for striking a ball and a rear surface opposite the outer surface;

a body joined to the face around peripheral edges of the face and extending rearwardly from the face, such that the body and the face combine to define an interior cavity surrounded by an interior surface of the head, the body having a crown and a sole, with the crown having an upper crown surface forming at least a portion of a top of the head and a lower crown surface opposite the upper crown surface and the sole having a bottom sole surface configured to confront a playing surface and an upper sole surface opposite the bottom sole surface, wherein the lower crown surface, the upper sole surface, and the rear surface of the face form portions of the interior surface of the head; and a bracing member connected to the interior surface of the head, the bracing member comprising a plurality of trusses connected to a plurality of connection points spaced from each other on the interior surface, with each truss extending inwardly into the interior cavity from the connection point thereof, such that the plurality of trusses form a bridge portion extending inwardly into the interior cavity and being spaced from the interior surface, wherein the plurality of trusses comprise a first truss having a first end connected to the lower crown surface and spaced rearwardly from the face.

2. The golf club head of claim 1, wherein the plurality of trusses further comprise a second truss having a second end connected to the upper sole surface, wherein the second end is spaced from the first end and spaced rearwardly from the face.

3. The golf club head of claim 2, wherein the bracing member is located at a rear of the body opposite the face.

4. The golf club head of claim 1, further comprising a second bracing member connected to the interior surface of the head, the second bracing member comprising a plurality of second trusses connected to a plurality of second connection points spaced from each other on the interior surface, with each second truss extending inwardly into the interior cavity from the second connection point thereof, such that the plurality of second trusses form a second bridge portion extending inwardly into the interior cavity and being spaced from the interior surface, wherein the bracing member and the second bracing member are separate from each other.

5. The golf club head of claim 4, wherein the bracing member and the second bracing member are symmetrically aligned with respect to the body.

6. The golf club head of claim 4, wherein the bracing member and the second bracing member are aligned in a row extending in a front-to-rear direction on the head.

7. The golf club head of claim 4, further comprising a third bracing member connected to the interior surface of the head, the third bracing member comprising a plurality of third trusses connected to a plurality of third connection points spaced from each other on the interior surface, with each third truss extending inwardly into the interior cavity from the third connection point thereof, such that the third trusses form a third bridge portion extending inwardly into the interior cavity and being spaced from the interior surface, wherein the third bracing member is separate from the bracing member and the second bracing member.

8. The golf club head of claim 1, wherein the plurality of trusses further comprise a second truss having a second end connected to the interior surface, wherein the first truss is joined to the second truss to define a generally triangular shape with the interior surface.

9. The golf club head of claim 1, wherein the first truss has a first distal end opposite the first end, wherein the plurality of trusses further comprise a second truss having a second end connected to the interior surface and a second distal end opposite the second end, a third truss having a third end connected to the interior surface that is spaced from the first and second ends and a third distal end opposite the third end, and a fourth truss having a fourth end connected to the interior surface that is spaced from the first, second, and third ends and a fourth distal end opposite the fourth end, wherein the second, third, and fourth trusses extend inwardly into the interior cavity from the interior surface to form at least a portion of the bridge portion.

10. The golf club head of claim 9, wherein the bracing member further comprises a connecting truss extending between the first distal end and at least one of the second, third, and fourth distal ends, wherein the connecting truss is spaced from the interior surface and forms at least a portion of the bridge portion.

11. A golf club head comprising:

a face having an outer surface configured for striking a ball and a rear surface opposite the outer surface;

a body joined to the face around peripheral edges of the face and extending rearwardly from the face, such that the body and the face combine to define an interior cavity surrounded by an interior surface of the head, the body having a crown and a sole, with the crown having an upper crown surface forming at least a portion of a top of the head and a lower crown surface opposite the upper crown surface and the sole having a bottom sole surface configured to confront a playing surface and an upper sole surface opposite the bottom sole surface; and a bracing member connected to the interior surface of the head, the bracing member comprising at least a first truss having a first end connected to the lower crown surface and spaced rearwardly from the face and a second truss having a second end connected to the upper sole surface and spaced rearwardly from the face, with the first truss extending inwardly into the interior cavity from the first end and the second truss extending inwardly into the interior cavity from the second end, such that the plurality of first and second trusses at least partially form a bridge portion extending inwardly into the interior cavity and being spaced from the interior surface.

12. The golf club head of claim 11, wherein the bracing member is located at a rear of the body opposite the face.

13. The golf club head of claim 12, wherein the first and second trusses are connected on upper and lower sides of a rearward-most point of the body.

14. The golf club head of claim 11, wherein the bracing member further comprises at least a third truss having a third end connected to at least one of the upper sole surface and the lower crown surface, wherein the third end is spaced from the first and second ends.

15. The golf club head of claim 11, wherein the first truss and the second truss have distal ends joined together to define a generally triangular shape, such that the first end, the second end, and the connected distal ends form three corners of the generally triangular shape.

16. A golf club head comprising:

a face having an outer surface configured for striking a ball and a rear surface opposite the outer surface;

a body joined to the face around peripheral edges of the face and extending rearwardly from the face, such that the body and the face combine to define an interior cavity surrounded by an interior surface of the head, the body having a crown and a sole, with the crown having an upper crown surface forming at least a portion of a top of the head and a lower crown surface opposite the upper crown surface and the sole having a bottom sole surface configured to confront a playing surface and an upper sole surface opposite the bottom sole surface, wherein the lower crown surface, the upper sole surface, and the rear surface of the face form portions of the interior surface of the head;

a first bracing member connected to the interior surface of the head, the first bracing member comprising a plurality of first trusses connected to a plurality of first connection points spaced from each other on the interior surface, with each first truss extending inwardly into the interior cavity from the first connection point thereof, such that the plurality of first trusses form a first bridge portion extending inwardly into the interior cavity and being spaced from the interior surface; and a second bracing member connected to the interior surface of the head, the second bracing member comprising a plurality of second trusses connected to a plurality of second connection points spaced from each other on the interior surface, with each second truss extending inwardly into the interior cavity from the second connection point thereof, such that the plurality of second trusses form a second bridge portion extending inwardly into the interior cavity and being spaced from the interior surface, wherein the bracing member and the second bracing member are separate from each other.

17. The golf club head of claim 16, wherein the first bracing member and the second bracing member are symmetrically aligned with respect to the body.

18. The golf club head of claim 16, wherein the first bracing member and the second bracing member are aligned in a row extending in a front-to-rear direction on the club head.

19. The golf club head of claim 16, further comprising a third bracing member connected to the interior surface of the head, the third bracing member comprising a plurality of third trusses connected to a plurality of third connection points spaced from each other on the interior surface, with each third truss extending inwardly into the interior cavity from the third connection point thereof, such that the plurality of third trusses form a third bridge portion extending inwardly into the interior cavity and being spaced from the interior surface, wherein the third bracing member is separate from the first bracing member and the second bracing member.

20. The golf club head of claim 16, wherein the first bracing member and the second bracing member are both connected to the lower crown surface.

21. The golf club head of claim 16, wherein the first bracing member and the second bracing member are both connected to the upper sole surface.

* * * * *